US010590803B2

(12) United States Patent
Quennehen et al.

(10) Patent No.: US 10,590,803 B2
(45) Date of Patent: Mar. 17, 2020

(54) TURBINE RING ASSEMBLY MADE FROM CERAMIC MATRIX COMPOSITE MATERIAL

(71) Applicants: SAFRAN AIRCRAFT ENGINES, Paris (FR); SAFRAN CERAMICS, Le Haillan (FR)

(72) Inventors: Lucien Henri Jacques Quennehen, Moissy-cramayel (FR); Gaël Frédéric Claude Cyrille Evain, Moissy-cramayel (FR); David Mathieu Paul Marsal, Moissy-cramayel (FR); Thierry Guy Xavier Tesson, Moissy-cramayel (FR)

(73) Assignees: SAFRAN AIRCRAFT ENGINES, Paris (FR); SAFRAN CERAMICS, Le Haillan (FR)

( * ) Notice: Subject to any disclaimer, the term of this patent is extended or adjusted under 35 U.S.C. 154(b) by 108 days.

(21) Appl. No.: 15/558,856

(22) PCT Filed: Mar. 15, 2016

(86) PCT No.: PCT/FR2016/050567
§ 371 (c)(1),
(2) Date: Sep. 15, 2017

(87) PCT Pub. No.: WO2016/146932
PCT Pub. Date: Sep. 22, 2016

(65) Prior Publication Data

US 2018/0073398 A1 Mar. 15, 2018

(30) Foreign Application Priority Data

Mar. 16, 2015 (FR) ..... 15 52145

(51) Int. Cl.
*F01D 25/28* (2006.01)
*F01D 25/24* (2006.01)
(Continued)

(52) U.S. Cl.
CPC ..... *F01D 25/246* (2013.01); *F01D 11/122* (2013.01); *F01D 25/28* (2013.01);
(Continued)

(58) Field of Classification Search
CPC ..... F01D 11/025; F01D 11/18; F01D 9/04; F05D 2230/64; F05D 2230/642; F05D 2250/75
See application file for complete search history.

(56) References Cited

U.S. PATENT DOCUMENTS 3,583,824 A * 6/1971 Smuland ..... F01D 11/18 415/117
6,884,026 B2 * 4/2005 Glynn ..... F01D 11/08 415/113
(Continued)

FOREIGN PATENT DOCUMENTS

WO WO 2010/103213 A1 9/2010

OTHER PUBLICATIONS

International Search Report as issued in International Patent Application No. PCT/FR2016/050567, dated Jun. 8, 2016.

*Primary Examiner* — Kevin R Steckbauer
(74) *Attorney, Agent, or Firm* — Pillsbury Winthrop Shaw Pittman LLP

(57) ABSTRACT

A turbine ring assembly includes ring sectors made as a single piece of ceramic matrix composite material and being for mounting on a metal ring support structure, the ring support structure having two tabs extending radially towards a gas flow passage, each ring sector having a first portion forming an annular base with a radially inside face defining
(Continued)

the inside face of the turbine ring and an outside face from which there extend two tab-forming portions, the ring sectors having a section that is substantially π shaped. The tabs of each ring sector fit axially over the tabs of the ring support structure with contact between the tabs of the ring support structure and the tabs of each ring sector when cold. The tabs of each ring sector are held to the ring support structure by pegs passing through holes formed in the tabs of each ring sector.

11 Claims, 3 Drawing Sheets

(51) Int. Cl.

| | |
|---|---|
| ***F01D 11/12*** | (2006.01) |
| *F01D 9/04* | (2006.01) |
| *F01D 11/02* | (2006.01) |
| *F01D 11/18* | (2006.01) |

(52) U.S. Cl.

CPC ..... *F01D 9/04* (2013.01); *F01D 11/025* (2013.01); *F01D 11/18* (2013.01); *F05D 2220/30* (2013.01); *F05D 2230/64* (2013.01); *F05D 2230/642* (2013.01); *F05D 2240/11* (2013.01); *F05D 2250/75* (2013.01); *F05D 2300/10* (2013.01); *F05D 2300/50212* (2013.01); *F05D 2300/6033* (2013.01)

(56) References Cited

U.S. PATENT DOCUMENTS

| | | | | |
|---|---|---|---|---|
| 7,494,317 | B2 * | 2/2009 | Keller | F01D 11/025 415/136 |
| 7,726,936 | B2 * | 6/2010 | Keller | F01D 11/12 415/173.4 |
| 9,587,517 | B2 * | 3/2017 | Vetters | F01D 25/246 |
| 9,598,975 | B2 * | 3/2017 | Uskert | F01D 11/24 |
| 9,863,265 | B2 * | 1/2018 | Stapleton | F04D 29/321 |
| 9,874,104 | B2 * | 1/2018 | Shapiro | F01D 25/246 |
| 10,030,541 | B2 * | 7/2018 | Vetters | F01D 25/246 |
| 10,415,426 | B2 * | 9/2019 | Quennehen | F01D 11/08 |
| 10,415,427 | B2 * | 9/2019 | Quennehen | F01D 25/005 |
| 10,428,688 | B2 * | 10/2019 | Quennehen | F01D 25/005 |
| 2004/0062639 | A1 * | 4/2004 | Glynn | F01D 11/08 415/134 |
| 2006/0292001 | A1 * | 12/2006 | Keller | F01D 11/025 415/170.1 |
| 2010/0104426 | A1 * | 4/2010 | Keller | F01D 11/12 415/173.1 |
| 2014/0271147 | A1 * | 9/2014 | Uskert | F01D 11/24 415/173.2 |
| 2016/0032776 | A1 * | 2/2016 | Voleti | F01D 21/045 415/200 |
| 2016/0186611 | A1 * | 6/2016 | Vetters | F01D 25/246 415/173.2 |
| 2016/0251982 | A1 * | 9/2016 | Shapiro | F01D 11/08 415/134 |
| 2016/0305265 | A1 * | 10/2016 | Stapleton | F04D 29/321 |
| 2017/0002674 | A1 * | 1/2017 | Vetters | F01D 25/246 |
| 2018/0080343 | A1 * | 3/2018 | Groleau | F01D 11/08 |
| 2018/0087399 | A1 * | 3/2018 | Quennehen | F01D 25/246 |
| 2018/0087401 | A1 * | 3/2018 | Quennehen | F01D 25/12 |
| 2018/0142572 | A1 * | 5/2018 | Quennehen | F01D 11/08 |
| 2018/0149034 | A1 * | 5/2018 | Roussille | F01D 11/08 |
| 2018/0156068 | A1 * | 6/2018 | Roussille | F01D 11/08 |
| 2018/0156069 | A1 * | 6/2018 | Quennehen | F01D 11/08 |
| 2018/0347384 | A1 * | 12/2018 | Kislinger | F01D 11/001 |
| 2018/0363506 | A1 * | 12/2018 | Tesson | F01D 25/005 |
| 2018/0363507 | A1 * | 12/2018 | Roussille | F01D 25/246 |
| 2018/0371948 | A1 * | 12/2018 | Lepretre | F01D 25/246 |

* cited by examiner

TURBINE RING ASSEMBLY MADE FROM CERAMIC MATRIX COMPOSITE MATERIAL

CROSS REFERENCE TO RELATED APPLICATIONS

This application is the U.S. National Stage of PCT/FR2016/050567 filed Mar. 15, 2016, which in turn claims priority to French Application No. 1552145, filed Mar. 16, 2015. The contents of both applications are incorporated herein by reference in their entirety.

BACKGROUND OF THE INVENTION

The invention relates to a turbine ring assembly for a turbine engine, the assembly comprising a plurality of ring sectors, each made of a single piece of ceramic matrix composite (CMC) material, together with a ring support structure.

The field of application of the invention is in particular that of gas turbine aeroengines. Nevertheless, the invention is applicable to other turbine engines, for example industrial turbines.

In gas turbine aeroengines, improving efficiency and reducing polluting emissions lead to reducing the weight of parts constituting the engine and to operating at ever-higher temperatures.

Ceramic matrix composite (CMC) materials are known for their good mechanical properties, which make them suitable for constituting structural elements, and they are also known for conserving those properties at high temperatures, thus constituting a viable alternative to the traditional use of metal to make parts.

The use of CMC parts in the hot portions of such engines has already been envisaged, for the above-mentioned reasons.

In particular, Document WO 2010/103213 discloses a turbine ring assembly for a turbine engine that comprises a plurality of ring sectors, each made of a single piece of CMC, each ring sector having a first portion forming an annular base with an inside face defining the inside face of the turbine ring and an outside face from which there extend two tab-forming portions having their ends engaged in housings in the ring support structure, the ring sectors possessing a section that is substantially π-shaped, and the ends of the tabs are held without radial clearance by the ring support structure.

In that document, the ring support structure is made of metal and is close to the flow passage for hot gas so that it is subjected to a considerable temperature rise. The metal structures are thus in a danger of being damaged by the high temperature of the gas in the passage.

Furthermore, CMC ring sectors can accept only very low levels of stress, they have high stiffness, and they expand much less than the metal ring support structure. Consequently, since according to the above-mentioned document the ring sectors are held without radial clearance, if ever they are subjected to very high temperatures they are weakened as a result of the mechanical stresses imposed by the differential expansion relative to the ring support structure.

OBJECT AND SUMMARY OF THE INVENTION

A main object of the present invention is thus to mitigate such drawbacks by proposing a turbine ring assembly that compensates for the differential expansion between the CMC ring sectors and the metal ring support structure, while protecting the ring support structure from the hot gas in the flow passage and while reducing the stresses imposed on the ring sectors at high temperature.

This object is achieved by a turbine ring assembly comprising a plurality of ring sectors, each ring sector being made as a single piece of ceramic matrix composite material and being for mounting on a metal ring support structure, the ring support structure having two tabs extending radially towards a gas flow passage, each ring sector having a first portion forming an annular base with a radially inside face defining the inside face of the turbine ring and an outside face from which there extend two tab-forming portions, the ring sectors having a section that is substantially π-shaped. In accordance with the invention, the tabs of each ring sector fit axially over the tabs of the ring support structure with contact between the tabs of the ring support structure and the tabs of each ring sector when cold, said tabs of each ring sector being held to the ring support structure by means of pegs passing through holes formed in the tabs of each ring sector and received in the tabs of the ring support structure, the holes in the tabs of each ring sector presenting a size greater than the diameter of the pegs so as to provide clearance when cold between the ring sector and the ring support structure.

When cold, the presence of clearance in the holes between the ring sector and the ring support structure allows for compensation for the differential expansion that exists between CMC and metal. The term "cold" should be understood as when the turbine engine is not in operation. More precisely, since metal expands more than CMC, and since the holes formed in the tabs in each ring sector are of dimensions greater than the pegs, they enable this expansion to be compensated while ensuring that the CMC ring sectors are held effectively without being excessively stressed at high temperature.

In addition, the differential expansion becomes advantageous since it provides sealing between each ring sector and the ring support structure. Specifically, when the turbine engine is in operation, the metal tabs of the ring support structure expand axially (i.e. in the flow direction of the gas stream through the turbine engine) so that they exert a small amount of pressure against the tabs of each ring sector that are fitted around them, thereby providing said sealing. In addition, since the ring support structure possesses two tabs that can be spaced apart by an empty space, each of the tabs presents a certain amount of flexibility that enables it, when hot, to withstand the stresses imposed in return by the more rigid CMC ring sector, and without the ring sector breaking.

Thus, since the ring support structure is fitted in sealed manner between the tabs of each CMC ring sector, it is protected from the hot gas in the flow passage, since CMC withstands high temperatures and forms a thermal barrier. This configuration makes it possible to reduce the cooling of the ring support structure and thus to reduce fuel consumption of the engine due to taking off the air needed for performing the cooling.

Preferably, at least one tab of each ring sector includes at least one oblong hole elongate in a circumferential direction so as to form clearance between the ring sector and the ring support structure.

The presence of these oblong holes elongate in a circumferential direction advantageously serves to compensate for the expansion of the ring support structure in the circumferential direction.

Also preferably, at least one tab of each ring sector includes at least one oblong hole elongate in a radial direction so as to form clearance between the ring sector and the ring support structure.

In the same manner as above, the oblong holes elongate in a radial direction serve to compensate the expansion of the ring support structure in the radial direction. Furthermore, when radial clearance remains while hot between the ring support structure and the ring sectors, the pressure difference between the outside face and the inside face of each ring sector serves to keep the sectors pressed against the flow passage.

In a first embodiment of the invention, each of the tabs of each ring sector includes at least one oblong hole elongate in a radial direction and at least two oblong holes elongate in a circumferential direction so as to form clearance between the ring sector and the ring support structure. The expansion of the ring support structure is thus compensated in both stress directions (radial and circumferential), thereby advantageously limiting the weakness of each ring sector and enabling the ring sectors to be held more effectively.

In a second embodiment of the invention, one tab of each ring sector includes at least two oblong holes elongate in a circumferential direction, and the other tab of each ring sector includes at least one oblong hole elongate in a radial direction so as to form clearance between the ring sector and the ring support structure.

Preferably, each peg has a head at an end opposite from its end received in the tab of the ring support structure. The presence of these heads on the pegs serves to facilitate installing and removing the ring sectors relative to the ring support structure.

More preferably, the pegs are received in blind holes formed in the ring support structure. Thus, the pegs are held axially by the abutment formed by the blind holes in the ring support structure, thereby holding the ring sectors effectively, while avoiding forming a passage for hot gas from the flow passage towards the inside of the ring support structure.

The inside face of each ring sector may be covered in an abradable coating.

The pegs are preferably made of metal. As a result, they may be received in the ring support structure without significant clearance and they can expand in the same manner as the ring support structure, while still holding the CMC ring sectors.

The invention also provides a turbine engine including a ring sector assembly as described above.

BRIEF DESCRIPTION OF THE DRAWINGS

Other characteristics and advantages of the present invention appear from the following description made with reference to the accompanying drawings, which show embodiments having no limiting character. In the figures.

DETAILED DESCRIPTION OF THE INVENTION

Figure 1:
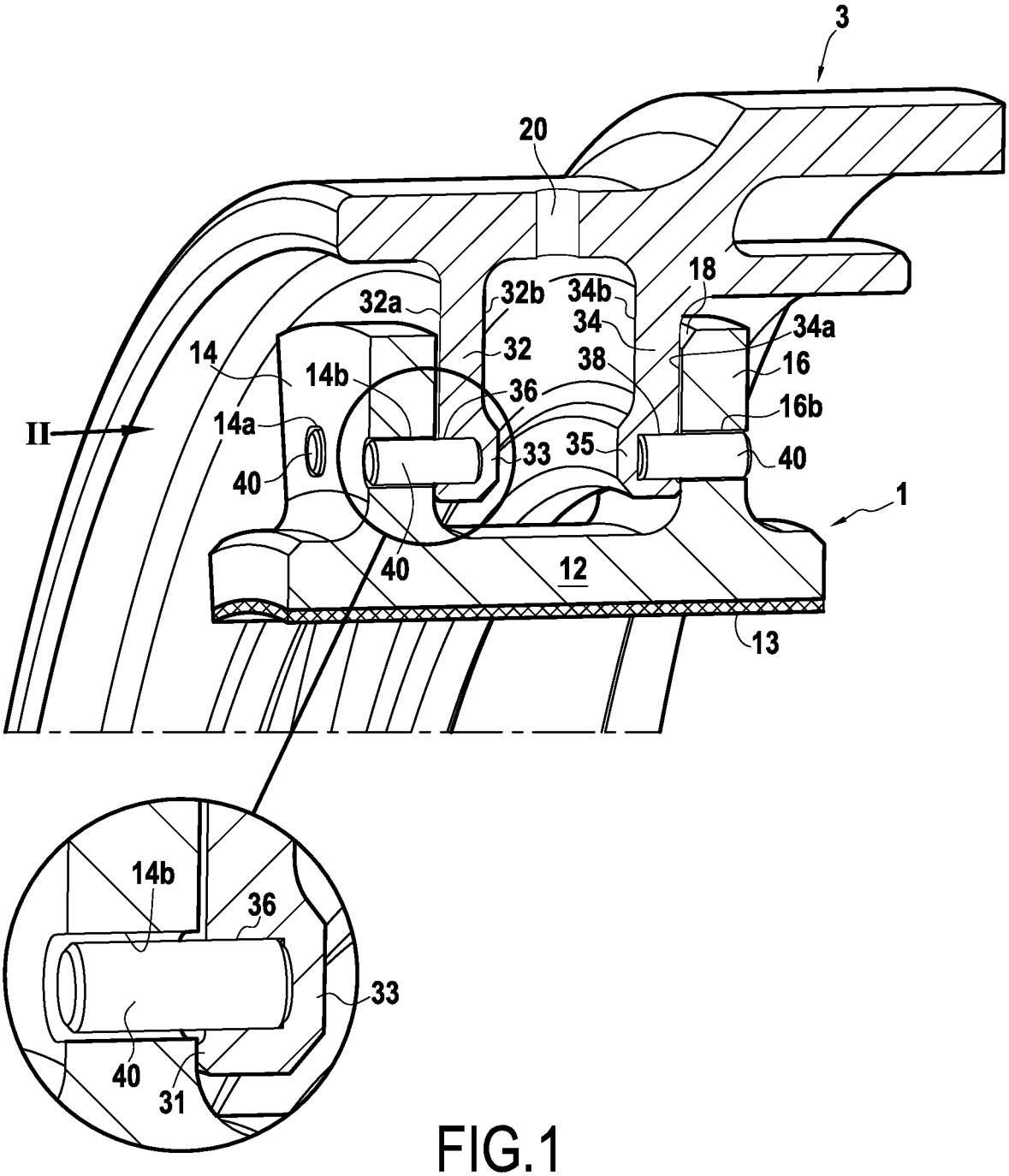
FIG. 1 is a diagrammatic perspective view of a turbine ring sector mounted on a ring support structure in a first embodiment of the invention.

FIG. 1 shows a CMC turbine ring sector 1 together with a metal ring support structure 3 in a first embodiment of the invention. In known manner, a ring sector assembly 1 is assembled so as to form a turbine ring that surrounds a set of rotary blades (not shown).

Each ring sector 1 presents a section that is substantially π-shaped, with an annular base 12 having its inside face coated in a layer 13 of abradable material so as to define the hot gas flow passage through the turbine. Tabs 14 and 16 of substantially rectilinear meridian section extend from the outside face of the natural base 12 over its entire length.

A plurality of drill holes 20 are provided through the outside wall of the ring support structure 3 so as to enable fluid flow communication towards the annular enclosure formed by the inside wall of the ring support structure 3, the outside wall of the annular base 12, and the walls 32*b*, 34*b* of the tabs 32, 34, so as to cool the annular base 12 by using air, e.g. taken from a point of the turbine engine upstream from its combustion chamber.

In known manner, each ring sector 1 is made of CMC, e.g. by forming a fiber preform having a shape close to that of the ring sector, and densifying the ring sector with a ceramic matrix.

In order to make the fiber preform, it is possible by way of example to use ceramic fiber yarns, e.g. SiC fiber yarns.

By way of example, the fiber preform is made by three-dimensional weaving or by multilayer weaving, with zones of non-interlinking being organized to enable preform portions corresponding to the tabs 14 and 16 to be moved away from the preform portion corresponding to the base 12. Such a method of fabricating a CMC ring sector is described in greater detail in Document WO 2010/103213.

Figure 2:
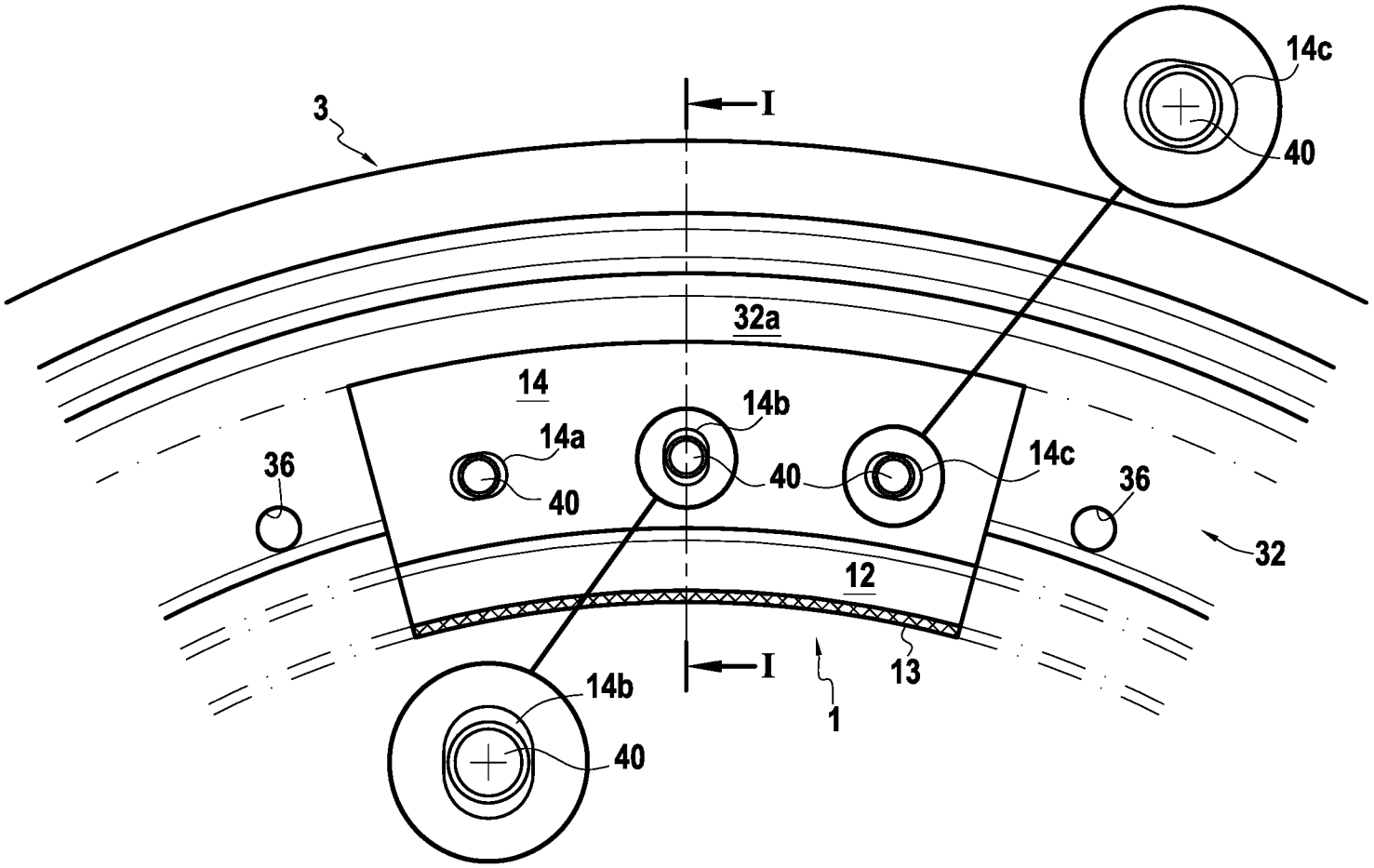
FIG. 2 is a view of the FIG. 1 ring sector looking along direction II.

The upstream tab 14 (where upstream and downstream are defined relative to the flow direction of the gas stream through the turbine) has a through centered oblong hole 14*b* formed therein elongate in a substantially radial direction, and two through oblong holes 14*a* and 14*c* elongate in a substantially circumferential direction on either side of the hole 14*b*, such that the hole 14*c* is the image of the hole 14*a* by axial symmetry relative to the radial axis I (FIG. 2) passing through the hole 14*b*

In a manner identical to the tab 14, the tab 16 has two through oblong holes elongate in a substantially circumferential direction (not shown in the figures) and an oblong hole 16*b* elongate in a substantially radial direction.

A chamfer 18 may be machined on the upstream side of the end of the downstream tab 34 of each ring sector 1 in order to facilitate assembling ring sectors on the ring support structure 3.

The ring support structure 3, which is secured to the casing of the turbine, has two tabs 32, 34 (or flanges) extending towards the inside of the gas flow passage. Each tab 32, 34 may extend continuously over the entire circumference of the ring support structure 3.

The upstream tab 34 of the ring support structure 3 has an upstream face 32*a* that is in contact with a projection 31 at the end of the upstream tab 14 of the ring sector 1. The downstream face 32*b* of the upstream tab 32 of the ring support structure 3 has a projection 33 over the entire circumference of the ring support structure. At the projection 33, the thickness of the upstream tab is greater.

In identical manner, the downstream tab 34 of the ring support structure 3 possesses a downstream face 34*a* that is in contact with a projection (not visible in the figures) at the end of the downstream tab 16 of the ring sector 1. The upstream face 34*b* of the downstream tab 34 of the ring support structure 3 has a projection 35 over the entire circumference of the ring support structure. At the projection 35, the thickness of the downstream tab is greater.

The projections 31 serve to control accurately the area of contact between the ring sector 1 and the ring support structure 3 while also providing good sealing between them.

Each tab 32, 34 of the ring support structure has blind holes 36, 38 formed therein situated level with the projections 33, 35 and distributed uniformly around the circumference of the ring support structure so as to face the oblong holes 14*a*, 14*b*, 14*c*, 16*b* of the ring sectors, once installed.

The tabs 32, 34 of the ring support structure are arranged so that the tabs 14, 16 of the ring sector 1 can fit axially around them with substantially no axial clearance.

Chamfers are machined on either side of the ends of the tabs 32, 34 of the ring support structure in order to facilitate installing the ring sectors.

Metal pegs 40 passing through each through hole 14*a*, 14*b*, 14*c* of a ring sector serve to hold the ring sector 1 on the tabs 32, 34 of the ring support structure 3. The pegs 40 are of a diameter that is smaller than the diameter of the holes 14*a*, 14*b*, 14*c* of each ring sector and substantially identical to the diameter of the blind holes 36, 38 of the ring support structure in which they are received. As a result, radial and circumferential clearance exists between the ring sectors and the ring support structure.

Figure 3A:
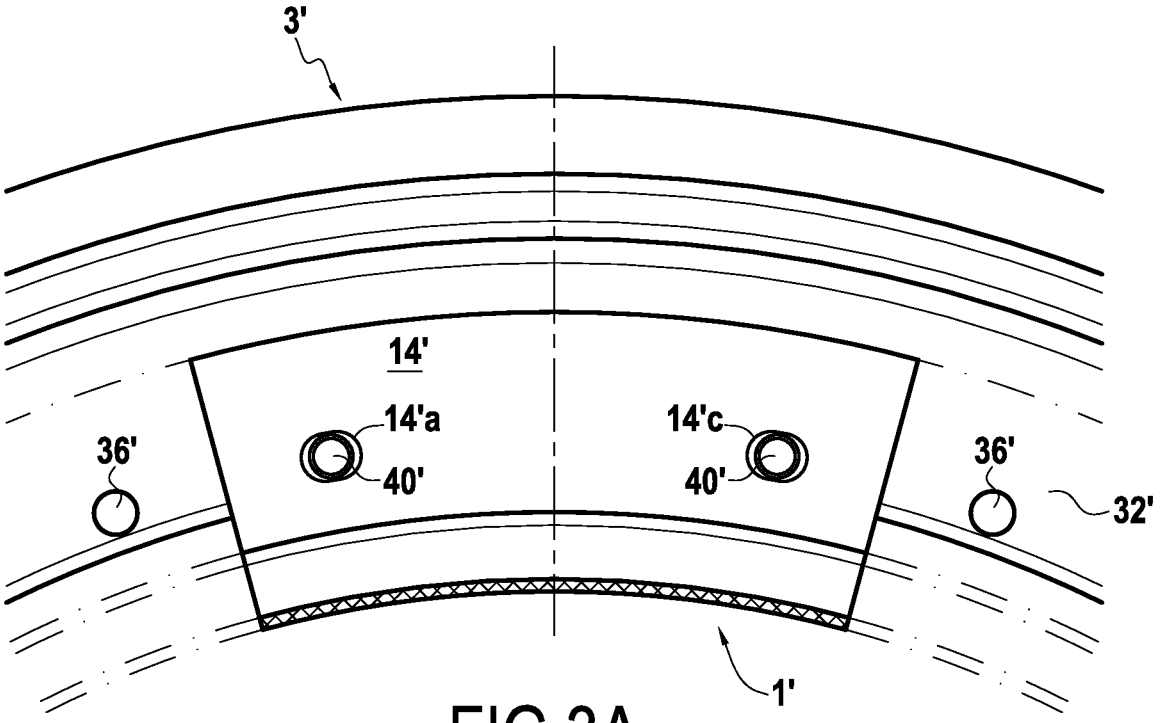
FIGS. 3A and 3B are views respectively from upstream and from downstream of a turbine ring sector mounted on a ring support structure in a second embodiment of the invention.
Figure 3B:
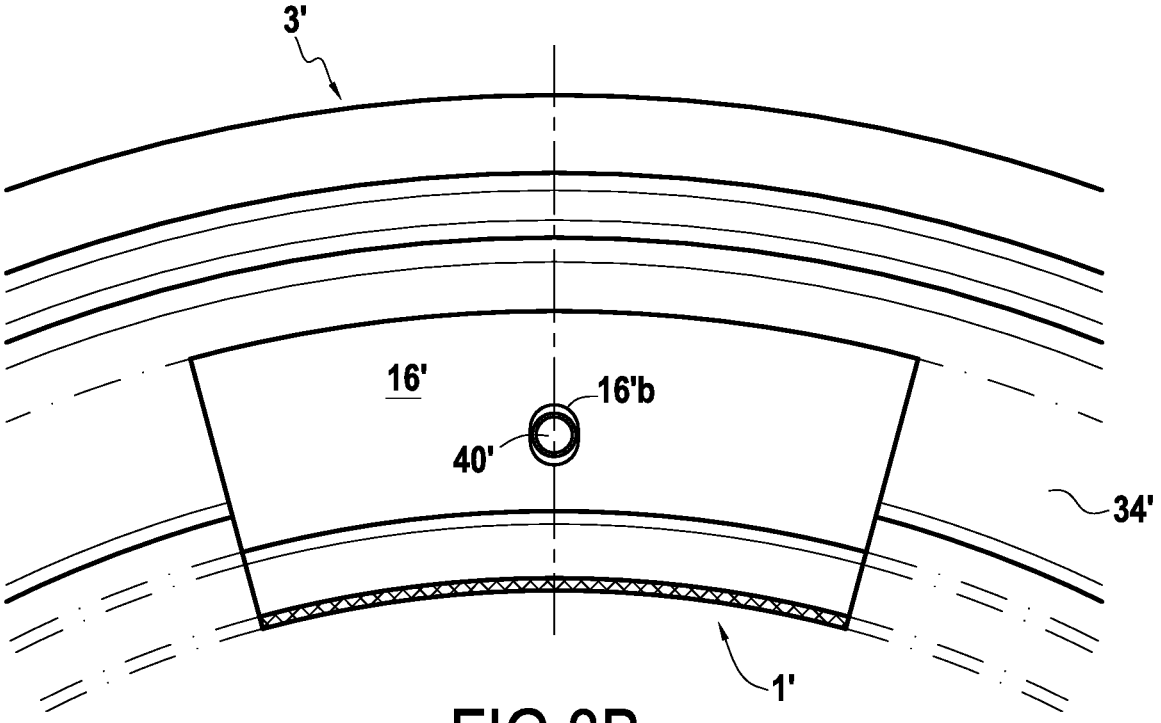

A second embodiment of the invention is shown in FIGS. 3A and 3B. When characteristics of the second embodiment of the invention are not described, they should be considered as being identical to characteristics of the first embodiment.

The upstream tab 14' of the ring sector has two through oblong holes 14'*a* and 14'*c* formed therein that are elongated in a substantially circumferential direction, and the downstream tab 16' of the ring sector has a through oblong hole 16'*b* formed therein in a centered position and that is elongate in a direction that is substantially radial.

The tabs 32', 34' of the ring support structure 3' have blind holes 36' formed therein (FIG. 3A) at the level of the projections that each of them presents, such that the tabs of the ring sector can be held by metal pegs 40' passing through the holes 14'*a*, 14'*c*, 16'*b* and received in the blind holes in the ring support structure 3'.

As in the first embodiment of the invention, the pegs 40' are smaller in diameter than the size of the through holes formed in the tabs of the ring sectors 1' and a diameter that is substantially equal to the diameter of the blind holes in the ring support structure 3', so as to obtain radial and circumferential clearance between each ring sector and the ring support structure.

It is possible to envisage interchanging the positions of the oblong holes between the upstream tab 14' and the downstream tab 16' (and thus of the blind holes 36' in the tabs of the ring support structure 3').

The pegs 40, 40' may have heads at their ends remote from their ends received in a tab of the ring support structure 3, 3' in order to facilitate installing and removing ring sectors 1, 1'.

The metal pegs 40, 40' may be of shapes other than the cylindrical shape shown in the figures.

In a variant, the holes 33, 35 formed in the tabs of the ring support structure may be through holes and the heads that are optionally present on the pegs can thus serve to hold them in one direction (upstream or downstream).

In order to provide sealing between ring sectors, sealing tongues (not shown) may be inserted between the ring sectors while they are being installed on the ring support structure.

The invention claimed is:

1. A turbine ring assembly comprising a metal ring support structure and a plurality of ring sectors, each ring sector being made as a single piece of ceramic matrix composite material and being mounted on the metal ring support structure, the ring support structure having tabs extending radially towards a gas flow passage, each ring sector having a first portion forming an annular base with a radially inside face defining an inside face of the turbine ring and an outside face from which there extend two adjacent tabs, the ring sectors having a cross-section that is substantially π-shaped, wherein the tabs of each ring sector fit axially over the tabs of the ring support structure with contact between the tabs of the ring support structure and the tabs of each ring sector when cold, said tabs of each ring sector being held to the ring support structure by pegs passing through holes formed in the tabs of each ring sector and received in the tabs of the ring support structure, the holes in the tabs of each ring sector presenting a size greater than the diameter of the pegs so as to provide clearance when cold between the ring sector and the ring support structure, and wherein all of the tabs of the ring support structure that receive said pegs are provided between the two adjacent tabs of the ring sector.

2. A turbine ring assembly according to claim 1, wherein at least one tab of each ring sector includes at least one oblong hole elongate in a circumferential direction of the turbine ring assembly so as to form clearance between the ring sector and the ring support structure.

3. A turbine ring assembly according to claim 1, wherein at least one tab of each ring sector includes at least one oblong hole elongate in a radial direction of the turbine ring assembly so as to form clearance between the ring sector and the ring support structure.

4. A turbine ring assembly according to claim 1, wherein each of the tabs of each ring sector includes at least one oblong hole elongate in a radial direction of the turbine ring assembly and at least two oblong holes elongate in a circumferential direction of the turbine ring assembly so as to form clearance between the ring sector and the ring support structure.

5. A turbine ring assembly according to claim 1, wherein one tab of each ring sector includes at least two oblong holes elongate in a circumferential direction of the turbine ring assembly, and wherein the other tab of each ring sector includes at least one oblong hole elongate in a radial direction of the turbine ring assembly so as to form clearance between the ring sector and the ring support structure.

6. A turbine ring assembly according to claim 1, wherein each peg has a head at an end opposite from its end received in the tab of the ring support structure.

7. A turbine ring assembly according to claim 1, wherein the pegs are received in blind holes formed in the ring support structure.

8. A turbine ring assembly according to claim 1, wherein the inside face of each ring sector is covered in an abradable coating.

9. A turbine ring assembly according to claim 1, wherein the pegs are made of metal.

10. A turbine engine including a turbine ring assembly according to claim 1.

11. A turbine ring assembly according to claim 1, wherein the two tabs of the ring support structure are separated by an empty space.

* * * * *